US007066106B2

(12) United States Patent
Giebeler

(10) Patent No.: US 7,066,106 B2
(45) Date of Patent: Jun. 27, 2006

(54) REVERBERATING MECHANICAL SIREN

(76) Inventor: James Frederick Giebeler, 3755 El Camino Dr., San Bernardino, CA (US) 92404

( * ) Notice: Subject to any disclaimer, the term of this patent is extended or adjusted under 35 U.S.C. 154(b) by 226 days.

(21) Appl. No.: 10/409,002

(22) Filed: Apr. 8, 2003

(65) Prior Publication Data

US 2004/0200401 A1 Oct. 14, 2004

(51) Int. Cl.
*G10K 7/00* (2006.01)

(52) U.S. Cl. ..... 116/147; 116/137 R

(58) Field of Classification Search ..... 116/137 R, 116/138, 139, 140, 142 R, 142 FP, 142 FV, 116/137 A, DIG. 18, DIG. 19
See application file for complete search history.

(56) References Cited

U.S. PATENT DOCUMENTS 539,711 A * 5/1895 Smith ..... 116/147
1,019,571 A * 3/1912 West ..... 116/138
1,428,684 A * 9/1922 Erick ..... 116/147
1,618,210 A * 2/1927 McClure ..... 116/147
1,772,614 A * 8/1930 Miles ..... 116/147
2,471,028 A * 5/1949 Fletcher ..... 116/147
3,089,458 A * 5/1963 Jacques ..... 116/147
4,138,673 A * 2/1979 Faust ..... 340/404.2
4,691,194 A * 9/1987 Kavcic ..... 340/404.2
4,847,590 A * 7/1989 Gosswiller ..... 340/404.2
5,146,434 A * 9/1992 Bromley ..... 367/140

FOREIGN PATENT DOCUMENTS

DE 3803388 A1 * 8/1989 ..... 116/147
JP 358055828 A * 4/1983 ..... 116/147

* cited by examiner

*Primary Examiner*—Christopher W. Fulton
*Assistant Examiner*—Travis Reis

(57) ABSTRACT

A small light mechanical siren for mobile emergency equipment which utilize spiral rebound ramps in the rotor to produce a loud penetrating square form spiral sound wave, enabling effective warning without contributing to noise pollution.

10 Claims, 4 Drawing Sheets

REVERBERATING MECHANICAL SIREN

REFERENCE TO RELATED APPLICATIONS

U.S. Pat. No. 1,566,761 December 1925 Miles Early Rotor
U.S. Pat. No. 1,586,101 May 1926 Miles Driven by Engine Fan Belt
U.S. Pat. No. 1,739,727 December 1929 Miles Coaster, Teach pumping out
U.S. Pat. No. 1,792,858 February 1931 Miles Poor Rotor
U.S. Pat. No. 2,068,427 January 1937 Meussdofor Direct Dricve, pull Brushes
U.S. Pat. No. 4,393,374 July 1983 Bandelj Cheap Siren, Poor rotor
U.S. Pat. No. 4,558,656 December 1985 Powell Comp Air Driven, tight fit rotor/stator

BACKGROUND OF THE INVENTION AMENDMENTS

Since the earliest days of mobile police, fire, and emergency medical services, mechanical sirens have helped to clear the way producing a particular whoo—whoo sound distinctly different from the bells, horns, and whistles of the other vehicles.

The present invention makes the unique sound by rapidly momentarily turning on-off-on-off the air flow of its centrifugal air pump. These sirens were originally hand cranked, later driven by friction wheels against other rotating machinery, and still later by their own electric motor. In his 1925 U.S. Pat. No. 1,566,761 Miles disclosed an open rotor with straight pumping vanes radiating from the center with small right angle end flanges for closing the stator ports. In a subsequent U.S. Pat. No. 1,739,727 Miles demonstrates curved vanes and confirms that "as the air is forced outwardly and the ports are intermittently opened and closed by the rotor flanges a loud noise will be produced."

Refinement of the siren during the 30's and 40's brought better rotor shapes for improved air flow, enclosed rotors for less resistance, and rotor clutches for coasting. The motor driven electromechanical sirens of the 60's were producing 120+decibels of square wave form sound from 10 inch diameter 37 pound machines drawing over 300 starting amps and 175 running amps of 12 volt power.

By the 70's increasing demand for electrical power in emergency equipment brought on by more warning lights, communication radios, and computers prompted the industry wide switch to electronic sirens requiring only 15 to 20 amps of power. These sirens mimic the whoo—whoo sound electronically with transistors and then project it from speakers. This sound is in a sine wave form, much like the ripples on the lake from where a rock was tossed.

During the last 30 years improvements in automobile insulation and soundproofing are rendering the electronic siren ineffective. It is not uncommon for the Fire Chief to have to climb down out of his fire truck and walk ahead to a stopped motorist so he can tap on their window in order to get their attention and ask them to pull their vehicle to the right.

However, the motor driven mechanical siren of this application with its square form sound wave penetrates through a closed modern vehicle, even with the air conditioning and the radio on, to alert the driver of an approaching emergency vehicle.

Therefore, there is a strong desire for a new mechanical siren which is only 5 inches in diameter and yet able to deliver an appropriate 123 decibels of sound while drawing only 28 amps of power.

BRIEF SUMMARY OF THE INVENTION AMENDMENTS

The present invention is directed to mechanical sirens and primarily to the rotor and stator which pump and redirect air. This rotor pumps air from the siren central intake bore and accelerates it to the rotor velocity of 10,700 feet per minute where half of it passes out to the outside, through slots in the siren stator. This function is like breathing, but this is not the source of the loud sound.

As the rotor revolves, every 15 degrees (for a 6 port), the stator blanks off the air pumping channels of the rotor completely. At this moment the accelerated air yet in the channels compresses, changes direction, and then bounces back out the throat. This is the source of the loud sound. In testing a siren in the open spaces, at 100 feet the rebound air sound wave is 6 dB louder than the exhaust air sound from the side slots, measured at a line 90 degrees to the intake and axis of rotation. On the logarithmic sound pressure scale, a 6 dB increase, nose to side, is a doubling of the sound.

A sirens effective performance efficiency may be measured as a function of auditable sound as measured in dB from inside of a closed modern insulated automobile, verses the input siren electrical power. To maximize this rebounding sound, several factors apply:

1) A key feature of this application is the shape of the rotor passages, with their opposing angles and bottom slope to direct these rebounding sound waves back out through the intake throat. Because the reverberating sound wave is traveling at 10,700 feet per minute or 122 miles per hour, it follows the rule of opposite same angle rebound (like billiard ball). Each unnecessary rebound uses wave velocity and acoustic energy, lessening the sirens effect. These fast waves pass through the slower incoming air. Tests proved that the addition of the 45 degree ramps between the rotor blades, alone added 3 dB to the sound output.
2) Accordingly, it is another object of the present invention to smooth finish the rotor cast surfaces to improve the accurate reflectivity of the rotor. Again, tests of unfinished rotors showed spotty irregular dB readings, where as a smooth finished rotor produced a consistently higher dB value or a louder sound.
3) A further feature of this invention is the full height of the rotor blades, from the front ring to the hub base, which grab air from the central bore. Tests proved that the complete full height of these blades added 2 dB of sound.
4) The diametrial clearance between rotor and stator effect the strength of the rebound wave. In a series of typical patents such as U.S. Pat. No. 4,558,656 Powell teaches the siren rotors/stator gap must be very, very close and even pre warmed before use. However, our experience revealed that by making proper momentary air dams around the rotor pumping channels, the rotor/stator gap may be large, even enough for mobile equipment operation and yet to provide the firm foundation for the rebounding sound wave.

A significant benefit of this siren to the community is the lessening of emergency vehicle noise pollution. By virtue of the spiraling square form wave, as generated by the mechanical siren, much of the sound has a short life, being dissipated as it strikes the ground and vegetation. However the broadly expanding horizontal sine wave pattern of the electronic siren is heard for long distances.

It is yet a further object of this present invention to provide a siren which produces sound waves with sufficient velocity to exceed the vehicle's speed, and thus improving the imminent safety of the emergency response crew.

These and other objects, features, aspects, and advantages of the present invention will become better understood with reference to the following description and accompanying drawings.

BRIEF DESCRIPTION OF THE DRAWINGS AMENDMENTS

Figure 1:
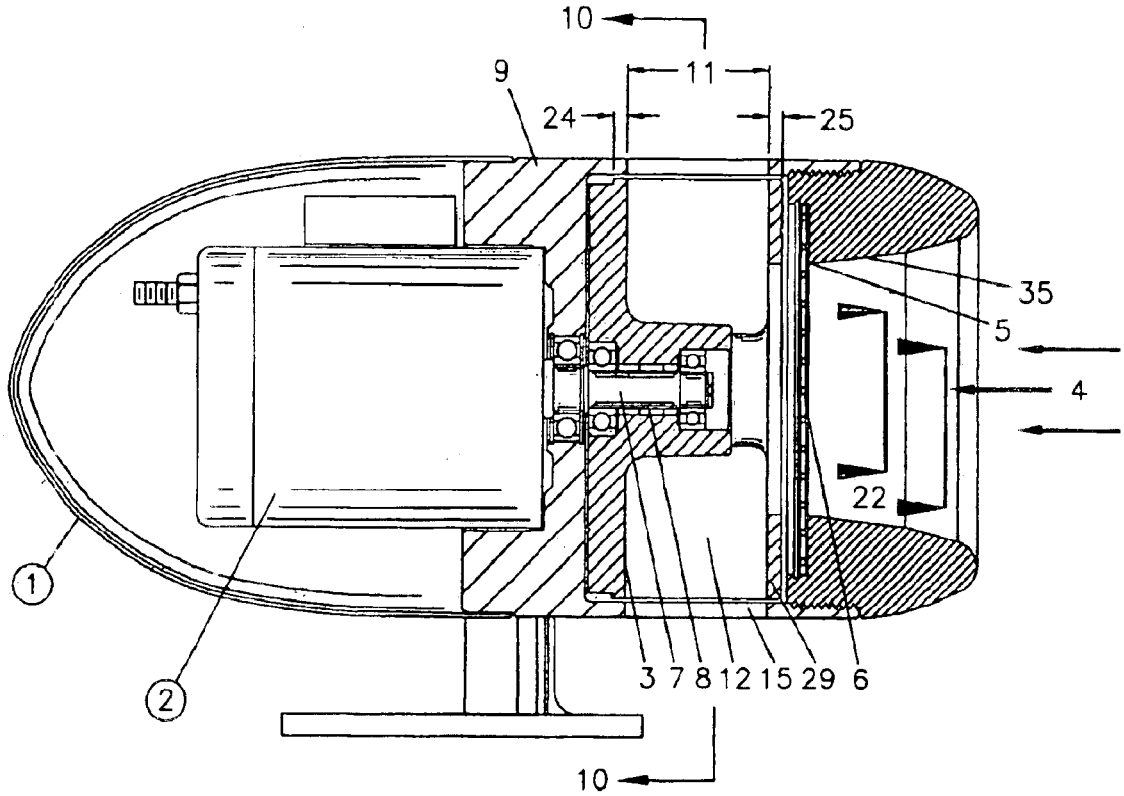
FIG. 1 is an elevational sectional view of the siren of the present invention.
Figure 5:
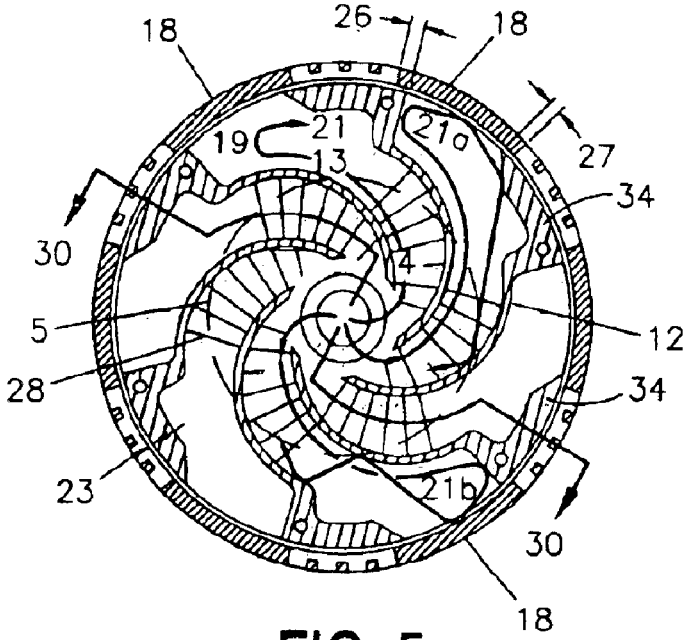

FIG. 5 is a sectional view taken on line 10—10 of FIG. 1 with rotor 3 rotated 15 degrees clockwise.

Figure 6:
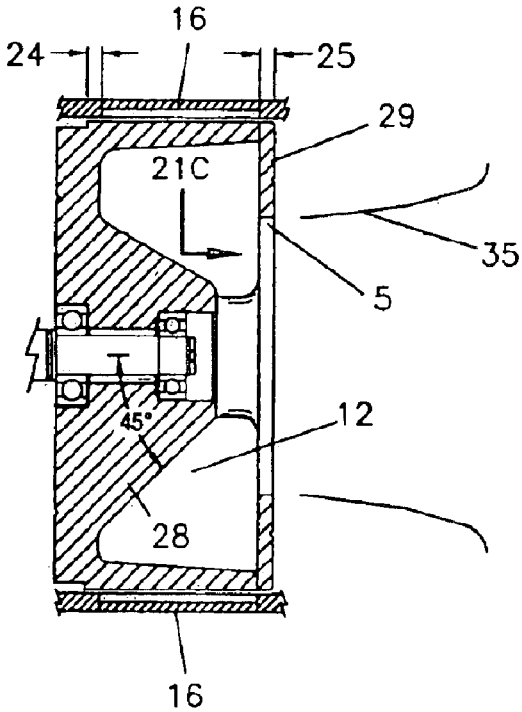

FIG. 6 is a sectional view of the rotor taken on line 30—30 of FIG. 5.

Figure 7:
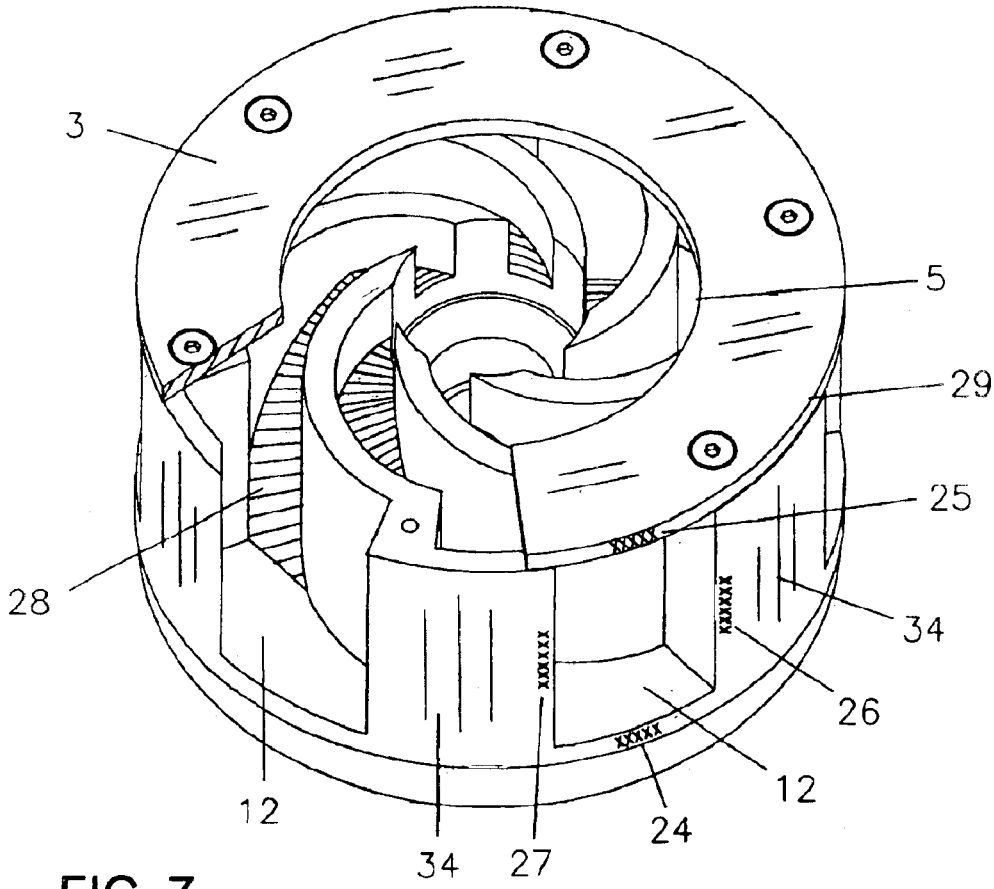

FIG. 7 is a perspective view of the rotor the present invention with a section the end ring removed.

Figure 3:
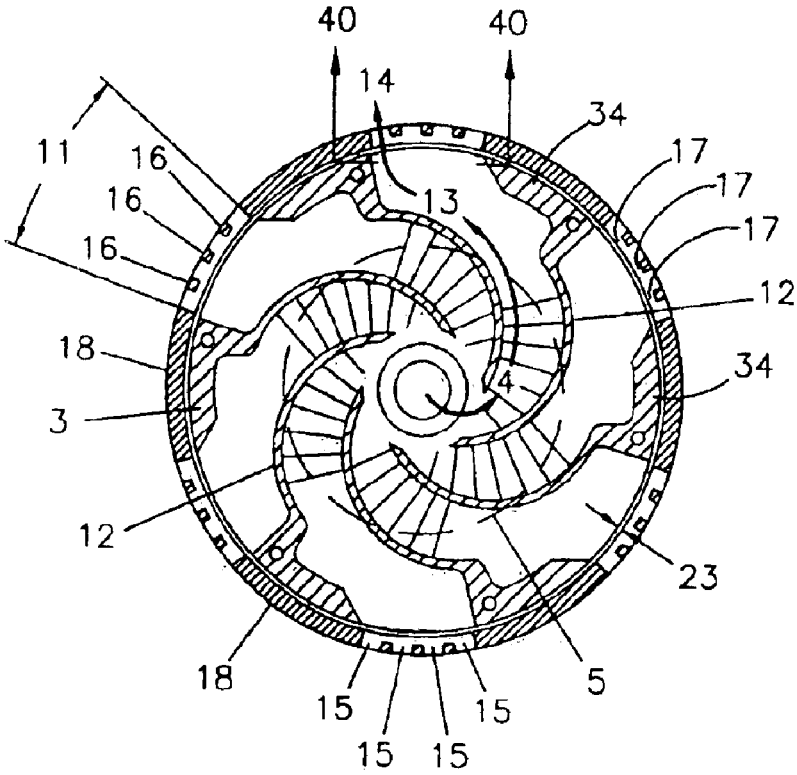
FIG. 3 is a sectional view taken on line 10—10 of FIG. 1.
Figure 8:
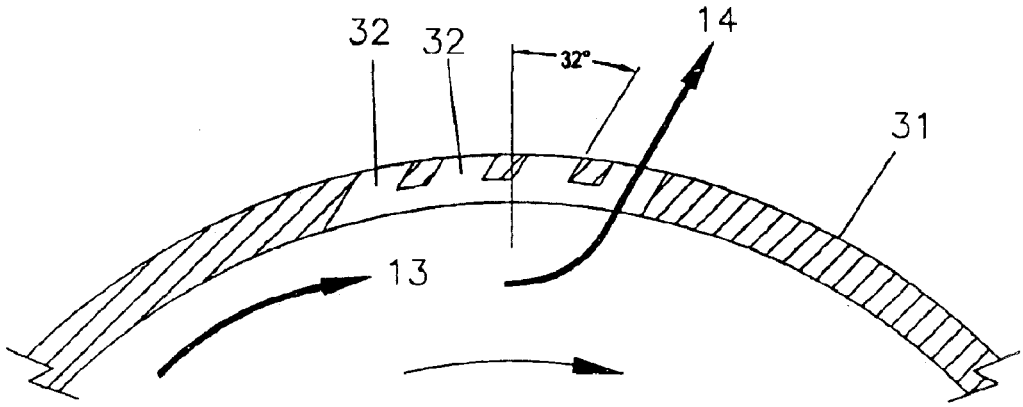

FIG. 8 is an enlarged sectional view of an alternate stator taken in the area of line 40—40 of FIG. 3.

DETAILED DESCRIPTION OF THE PRESENT INVENTION AMENDMENTS

Referring to the drawings, FIG. 1 shows a mechanical siren assembly 1 which has an electric motor assembly 2 driving rotor 3 which pumps incoming air 4 from diverging nose 35 and throat 5 through screen 6. Said rotor 3 is driven in the clockwise direction by motor shaft 7 through a one-way roller clutch 8 in rotor 3. The rotor 3 is bearing mounted to shaft 7, to freely coast on said shaft 7 in stator 9 which is integral with the motor end bell.

Figure 2:
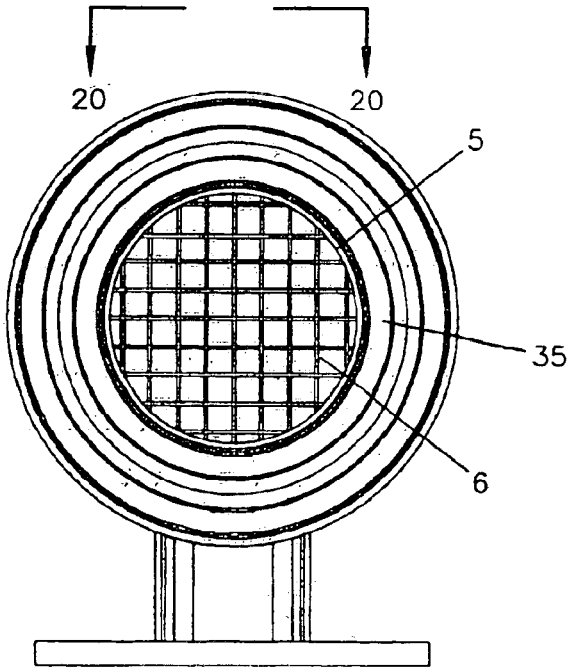
FIG. 2 is an end view of the siren.

FIG. 2 is an end view of the siren 1 showing the diverging nose 35, throat 5 and screen 6.

Now turning to FIG. 3, the sectional view shows rotor 3 with 6 blades. This typical siren has a pitch of 900 hz. A siren with a 5 bladed rotor would have a pitch of 750 hz. The pumping channels 12 of rotor 3 are shown aligned with the windows 11 allowing this accelerated air 13 to exit as exhaust 14 with the least possible resistance. This process might be liked to the siren's breathing. Window 11 is formed by a multiple of slots 15 which form safety bars 16 across said window. Yet another novel feature of this application is the back cutting of bars 16 as undercut 17 to prevent false openings and closings of rotor pumping channels 12 with the stator window 11.

Figure 4:
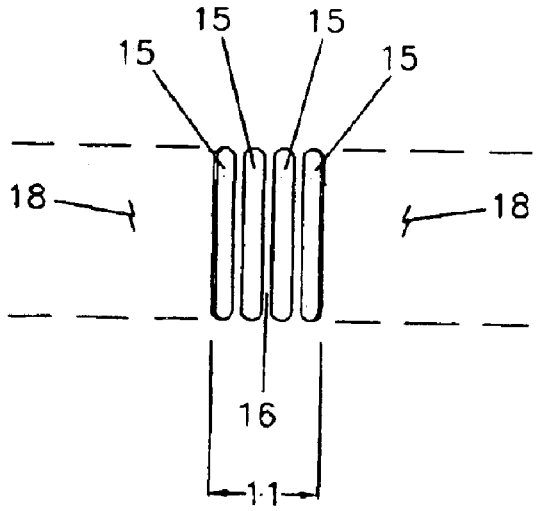
FIG. 4 is a plan view of the siren stator in the area of line 20—20 of FIG. 2.

FIG. 4 shows the area of window 11 with longitudinal slots 15, safety bars 16, and stator blank portion 18. It is very important to have straight edges for instant opening and closing of the stator window 11 and rotor pumping channel 12 to produce the bright crisp square wave.

FIG. 5 shows rotor 3 revolved 15 degrees clockwise as it accelerates air 13. The blank portion 18 of stator 9 closes off the pumping channels 12 of rotor 3, and diametrial flange 34 closes off window 11 in stator 9. At this moment, accelerated air 13 compresses and reverses direction at 19. Then the compressed air bounces back as a high pressure rebounding wave 21. This rebounding wave 21 follows the rule of "opposite same angle rebound" as it passes through the pumping channels 12 to collect with other individual waves and exit the siren from the throat 5 as a spiraling pulsing wave 22. Alternate rebound courses might be depicted by line 21*a* and line 21*b*.

In order to maximize this rebounding sound wave 21, a firm crisp square wave must be generated. Factors effecting this wave are: 1) the diametrial clearance 23 between the outside of the rotor 3 and the inside the stator 9, and 2) the lower axial overlap 24 which is equal to the upper axial overlap 25, seen in FIG. 1, and 3) the left circumferential overlap 27 and the right circumferential overlap 26 which are between the rotor pumping channel 12 and stator blank portion 18, seen in FIG. 5, which form momentary radial air dams.

Now, these air dams around the rotor pumping channels 12 establish the firm footing for the rebounding sound wave 21 to press against, allowing the rotor/stator clearance 23 to be the maximum (large) gap for mobile equipment operation and yet provide the desired warning sound.

FIG. 6 shows another novel feature, as line 21*c* defines a potential course for the rebounding wave to encounter spiral ramp 28. These spiral ramps are essentially perpendicular to the pumping channel walls and rise from the rotor floor at a 45 degree angle to the axis of rotation, so as to direct the waves 21 out through the throat 5 and diverging nose 35 with a single rebound, thus conserving acoustic energy. Disk 29 closes off pumping channels 12 and performs the upper axial overlap 25.

FIG. 7 shows in perspective view the rotor 3 with a section of disk 29 removed to reveal spiral ramps 28 Which direct rebounding waves 21 through throat 5. Axial overlap 24 and 25, and circumferential overlap 26 and 27 of the rotor pumping channel 12 to the stator blank portion 18, form momentary air dams.

FIG. 8 shows in an enlarged view of an alternate stator 31 which features angled slots 32 aligned to the direction of accelerated air 13 which is to exit as exhaust 14. This angled slot lessens the resistance to air flow and thus increases the siren's efficiency.

Although a preferred embodiment has been shown and described, it will be apparent to those skilled in the art that many changes and modifications may be made without departing from the spirit and scope of the present invention.

What is claimed is:

1. A Siren comprising a siren stator; a siren rotor; said rotor comprising a hub, and a plurality of rotor pumping channels having spiral ramps disposed between a plurality of channel blades, said spiral ramps rising from a rear driving disk substantially at right angles to said channel blade walls, said spiral ramp angled substantially at 45 degrees to a rotor axis of rotation, so as to change the direction of a rebounding sound wave from radially inward to directly out through an intake throat and a nose in one single rebound, according to a rule of opposite and same angle rebound.

2. The Siren of claim 1 wherein said siren stator has slots; and wherein said siren rotor has said plurality of channel blades being curved air pumping blades radiating out from said hub, each connecting with a short straight blade portion substantially radial to said hub and further connecting to a diametrial flange segment large enough to cover completely an opposing siren stator's slots, said air pumping blades being mounted between said rear driving disk and a front ring having a bore to match a siren intake bore.

3. The Siren of claim 2 wherein said siren rotor grabs air from said intake bore by means of the curved air pumping blades radiating out from said hub extending from said rear driving disk to the front ring.

4. The Siren of claim 1 wherein said siren rotor comprises said opposing blade channel faces are appropriately angled according to said rule of opposite and same angle rebound wherein said channel blades direct a reverberating sound wave by using the substantially shortest route back through said rotor pumping channel toward the hub, with the fewest possible number of rebounds.

5. The Siren of claim 1 wherein said siren rotor comprises said channel blades have polished cast integral blade surfaces to increase the face reflectivity of said channel blades, thus reducing sound loss and rebound energy loss of said rebounding sound waves, said rotor is made with a detachable front ring to facilitate manufacture.

6. The Siren of claim 1 wherein said siren rotor comprises in which said rotor pumping channels have a flat bottom beyond said 45 degree angled spiral ramps, said spiral ramps rising centrally to the height of said hub, where said ramps are positioned to redirect said rebounding sound waves directly through said intake throat.

7. The Siren of claim 1 wherein said siren rotor comprises a front ring with a front ring width said rear rotor disk width, a stator blank space circumferential overlap with a width, and widths beside either side of said rotor pumping channel being substantially equal and forming equal width air dams surrounding said rotor pumping channels, to decrease rebound air leakage, substantially preserving acoustic energy imparted to said rebounding sound waves.

8. A Siren of claim 1, wherein said siren stator comprises a plurality of window openings corresponding in size to said rotor pumping channels, said window openings being formed by plural slots substantially parallel to a siren axis of rotation and radial to said siren axis of rotation's center said slots having bars with undercuts wherein said bars are spaced away from a bore of said stator, thus said slots and said bars do not change the siren pitch because of additional openings and closings with said rotor.

9. The Siren of claim 1, wherein said siren stator comprises a plurality of window openings corresponding in size to said rotor pumping channels, said window openings being formed by plural slots substantially parallel to a siren axis of rotation's center; said slots being angled at nearly 32 degrees to a radial center line, aligned substantially parallel to a natural path of accelerated air exiting from said rotor, wherein said angled slots do not reduce the velocity of the accelerated air exiting from said rotor.

10. A Mechanical Siren 1 comprising an electric motor 2 driving through a clutch 8, a stator; and a rotor 3, having a plurality of pumping channels 12 having spiral ramps 28 disposed between said rotor's blades substantially at right angles to said blade's walls, said ramps angled substantially at 45 degrees to a rotor axis of rotation, so as to change direction of rebounding sound waves 21 from radially inward to directly out through an angled throat 5 and nose 35 in one single rebound, said rotor 3 mounted with bearings to promote coasting, said rotor 3 further comprising a front ring 29 with a front ring width, a rear rotor disk, with a rear rotor disk width 24, a stator blank space circumferential overlap with a width 18, and widths 26 and 27 beside either side of said rotor pumping channel 12, wherein said width measurements are all substantially equal, forming equal width air dams surrounding pumping channel 12, to decrease rebound air leakage, substantially preserving acoustic energy imparted to said rebounding sound waves 21, said stator 9 having multiple window openings 11 corresponding in size to said rotor pumping channels 12, said window openings 11 being formed by plural slots 15 substantially parallel to a siren axis of rotation and radial to said siren axis of rotation's center, said slots 15 having bars 16 with under cuts 17, so that said bars 16 are spaced away from a bore of stator 9, thus said slots 15 and bars 16 do not change siren pitch because of additional openings and closings with rotor 3, said rebounding sound waves 21 combine as a spiraling pulsing wave 22 to exit through said nose 35 with its angled intake throat to guide said rebounding sound waves 22 in an expanding pattern without cavitations and eddy currents.

* * * * *